US010573961B2

(12) United States Patent
Ng et al.

(10) Patent No.: US 10,573,961 B2
(45) Date of Patent: Feb. 25, 2020

(54) ANTENNA HOUSING ASSEMBLIES AND METHODS OF ASSEMBLING ANTENNA HOUSINGS

(71) Applicant: Laird Technologies, Inc., Earth City, MO (US)

(72) Inventors: Wei Tat Ng, Kedah (MY); Chit Yong Hang, Penang (MY); Michael James McGinnis, Windham, NH (US)

(73) Assignee: Laird Connectivity, Inc., Akron, OH (US)

( * ) Notice: Subject to any disclaimer, the term of this patent is extended or adjusted under 35 U.S.C. 154(b) by 246 days.

(21) Appl. No.: 15/660,586

(22) Filed: Jul. 26, 2017

(65) Prior Publication Data

US 2018/0040949 A1 Feb. 8, 2018

(30) Foreign Application Priority Data

Aug. 3, 2016 (MY) ..... PI2016702833

(51) Int. Cl.
*H01Q 1/42* (2006.01)
*H01Q 1/04* (2006.01)

(52) U.S. Cl.
CPC ..... *H01Q 1/42* (2013.01); *H01Q 1/04* (2013.01)

(58) Field of Classification Search
CPC ..... H01Q 1/42; H01Q 1/421; H01Q 1/422; H01Q 1/424; H01Q 1/425; H01Q 1/427; H01Q 1/428
See application file for complete search history.

(56) References Cited

U.S. PATENT DOCUMENTS 5,757,324 A * 5/1998 Helms ..... H01Q 1/42 343/700 MS
5,835,064 A 11/1998 Gomez et al.
7,688,277 B2 3/2010 Brocheton et al.
7,969,379 B2 6/2011 Knudsen et al.
9,331,390 B2 5/2016 Petropoulos
9,608,318 B2 3/2017 Tan et al.
(Continued)

FOREIGN PATENT DOCUMENTS

CN 101449430 A 6/2009
CN 102035062 A 4/2011
(Continued)

*Primary Examiner* — Daniel Munoz
(74) *Attorney, Agent, or Firm* — Harness, Dickey & Pierce, P.L.C.; Anthony G. Fussner

(57) ABSTRACT

Exemplary embodiments are provided of antenna housing assemblies. In an exemplary embodiment, an assembly generally includes a radome having an outer surface, an inner surface, a first end, and a second end opposite the first end. A top cap is coupled to the first end of the radome via an ultrasonic weld joint. A first sealing member is disposed about the top cap such that the first sealing member is positioned between the top cap and the inner surface of the radome. A bottom cap is fastened to the second end of the radome via an ultrasonic weld joint. A second sealing member is disposed about the bottom cap such that the second sealing member is positioned between the bottom cap and the inner surface of the radome. Exemplary methods of assembling antenna housings are also disclosed.

20 Claims, 18 Drawing Sheets

(56) References Cited

U.S. PATENT DOCUMENTS

| | | | | |
|---|---|---|---|---|
| 2002/0106935 | A1* | 8/2002 | Udd | G06F 1/186<br>439/540.1 |
| 2006/0202904 | A1* | 9/2006 | Noro | H01Q 1/362<br>343/872 |
| 2009/0021445 | A1 | 1/2009 | Knudsen et al. | |
| 2014/0285394 | A1* | 9/2014 | Truthan | H01Q 1/242<br>343/860 |

FOREIGN PATENT DOCUMENTS

| | | | |
|---|---|---|---|
| WO | WO-2007139654 | A1 | 12/2007 |
| WO | WO-2013028052 | A1 | 2/2013 |
| WO | WO-2015147906 | A1 | 10/2015 |

* cited by examiner

ANTENNA HOUSING ASSEMBLIES AND METHODS OF ASSEMBLING ANTENNA HOUSINGS

CROSS-REFERENCE TO RELATED APPLICATION

This application claims the benefit of and priority to Malaysian Patent Application No. PI 2016702833 filed Aug. 3, 2016. The entire disclosure of the above application is incorporated herein by reference.

FIELD

The present disclosure generally relates to antenna housing assemblies and methods of assembling antenna housings.

BACKGROUND

This section provides background information related to the present disclosure which is not necessarily prior art.

A cylindrical radome is a common design for an antenna housing. While such housings are often lightweight and inexpensive, the transmission line and other sensitive parts of the antenna are exposed to environmental elements (e.g., dirt, dust, water, etc.) and susceptible to damage thereby. Such exposure and damage leads to downtime and required maintenance of the antenna and/or antenna housing.

DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings.

Exemplary embodiments are provided of antenna housing assemblies. In an exemplary embodiment, an antenna housing assembly generally includes a radome (e.g., a cylindrical radome in scalable diameters and lengths, etc.), having an outer surface, an inner surface, a first end, and a second end opposite the first end. A top cap is coupled to the first end of the radome via an ultrasonic weld joint. A first sealing member (e.g., O-ring, urethane foam sealing member, a resiliently compressible elastomeric or foam sealing member, a PORON microcellular urethane foam sealing member, etc.) is disposed about the top cap such that the first sealing member is positioned between the top cap and the inner surface of the radome. A bottom cap is fastened to the second end of the radome via an ultrasonic weld joint. A second sealing member (e.g., O-ring, urethane foam sealing member, a resiliently compressible elastomeric or foam sealing member, a PORON microcellular urethane foam sealing member, etc.) is disposed about the bottom cap such that the second sealing member is positioned between the bottom cap and the inner surface of the radome. The top and bottom caps may be fastened to the radome using ultrasonic weld joints to inhibit dust and water from entering the housing. Exemplary methods of assembling an antenna housing are also disclosed.

Figure 1:
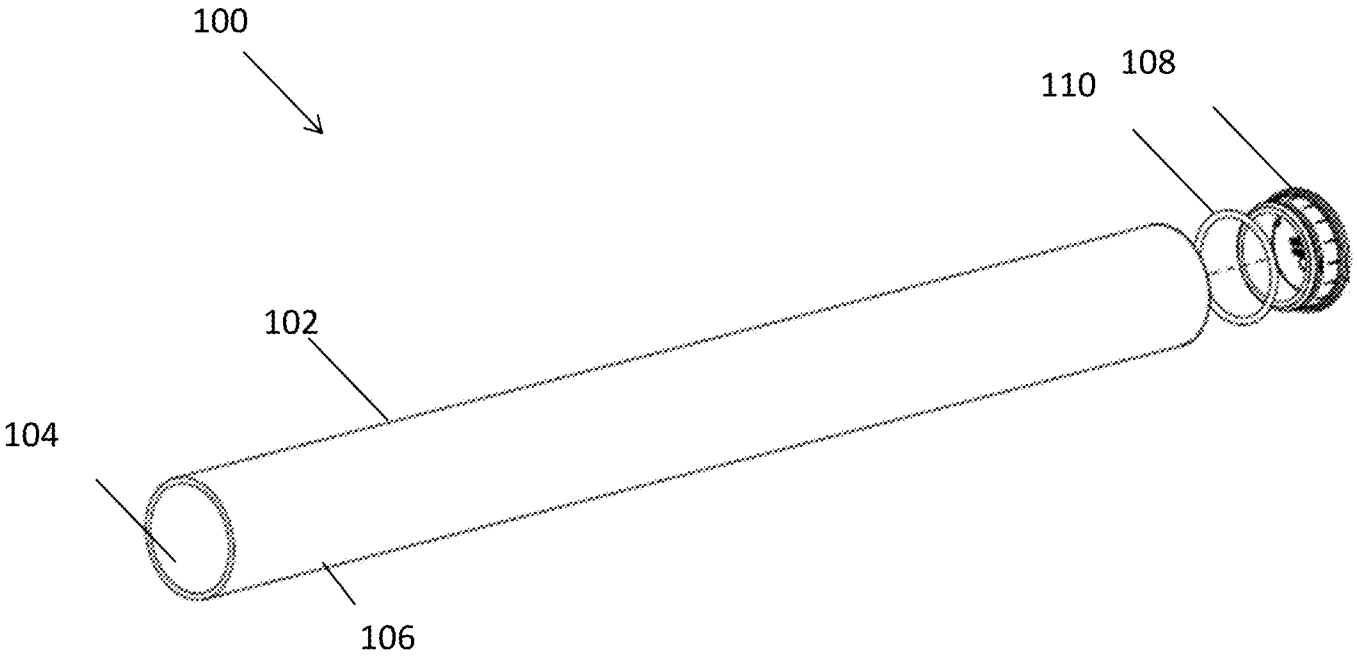
FIG. 1 is an exploded perspective view of an antenna housing assembly according to an exemplary embodiment.
Figure 2:
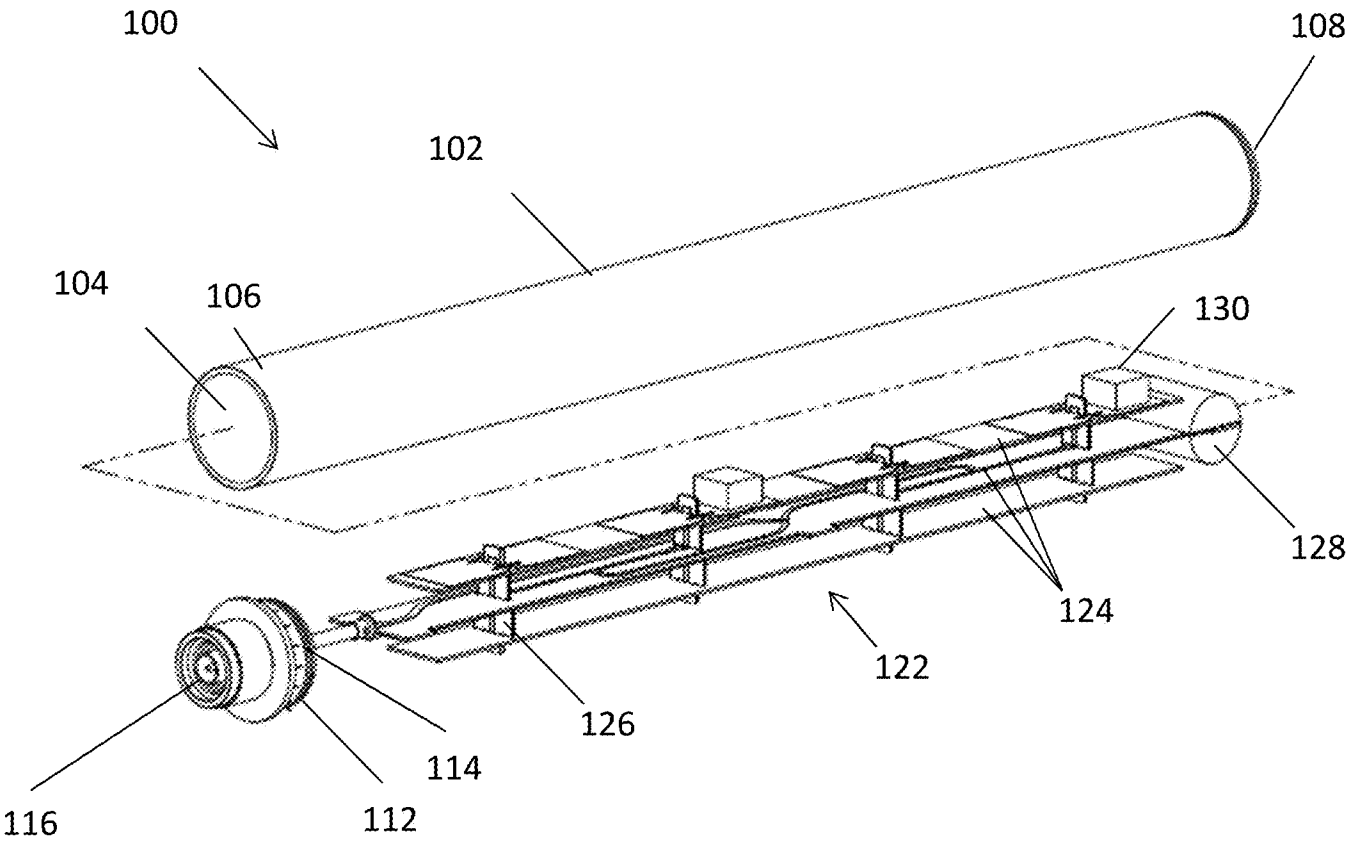
FIG. 2 is an exploded perspective view of the antenna housing assembly shown in FIG. 1, and further illustrating a bottom cap and an antenna element.
Figure 3:
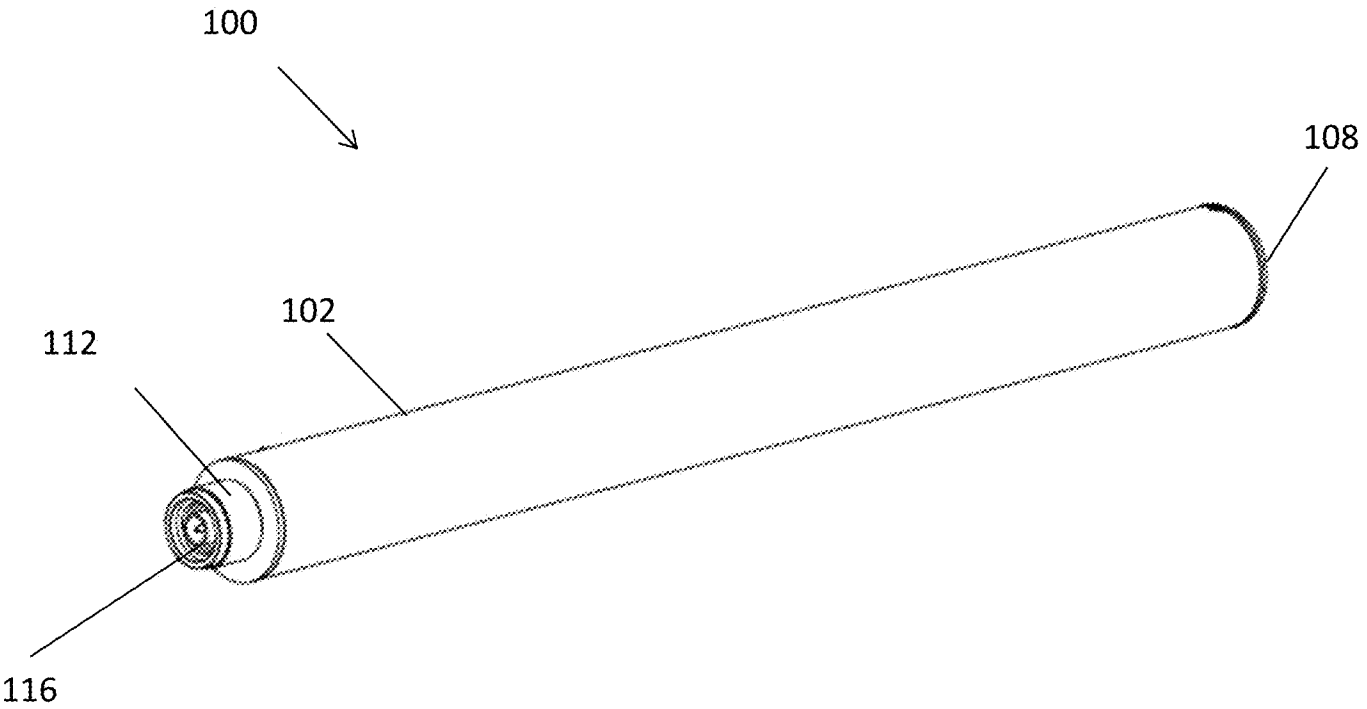
FIG. 3 is a perspective view of the antenna housing assembly shown in FIG. 2 showing the bottom cap coupled to the radome after the antenna element has been positioned within the radome.

As shown in FIGS. 1, 2, and 3, an exemplary embodiment of an antenna housing assembly 100 includes a cylindrical radome 102 (broadly, a radome) having an inner surface 104 and an outer surface 106, a top cap 108, a bottom cap 112, and two O-rings 110, 114 (broadly, sealing members). In some embodiments, the antenna housing assembly 100 may include an omnidirectional antenna housing assembly.

The top cap 108 is coupled to the radome 102 via an ultrasonic weld to inhibit dust and water from entering the radome 102. The O-ring 110 is disposed about the top cap 108 such that when the top cap 108 is coupled to the radome 102 the O-ring 110 is positioned between the top cap 108 and the inner surface 104 of the radome 102. For example, FIG. 1 illustrates the O-ring 110 before it is placed about the top cap 108 and before the top cap 108 is coupled to the radome 102.

The bottom cap 112 is coupled to the radome 102 via an ultrasonic weld to inhibit dust and water from entering the radome 102. The O-ring 114 is disposed about the bottom cap 112 such that when the bottom cap 112 is coupled to the radome 102 the O-ring 114 is positioned between the bottom cap 112 and the inner surface 104 of the radome 102. For example, FIG. 2 illustrates the O-ring 114 placed about the bottom cap 112 before the top cap 108 is coupled to the radome 102. The bottom cap 112 is coupled to the radome 102 at an end of the radome 102 opposite the top cap 108.

The ultrasonic weld joints between the radome 102 and the top cap 108 and bottom cap 112 can provide primary seals to inhibit dust, water, etc. from entering the radome 102, while the O-rings 110, 114 disposed about the top cap 108 and the bottom cap 112 can provide secondary seals to inhibit dust and water from entering the radome 102. For example, if dust, water, etc. penetrate through one of the ultrasonic weld joints, the O-rings can provide a secondary seal to inhibit water from entering the radome 102 to damage any antenna elements, electrical components, etc. disposed in the radome 102.

Accordingly, in some embodiments the ultrasonic welds and O-rings 110, 114 may provide IP67 ingress protection for the radome 102, by inhibiting dust, water, etc. from entering the radome 102. For example, the ultrasonic welds and O-rings 110, 114 may prevent any ingress of dust into the radome 102. The ultrasonic welds and O-rings 110, 114 may prevent any ingress of water into the radome 102 in a harmful quantity at up to one meter of water depth for at least thirty minutes. For the IP67 ingress protection standard, 6 indicates total protection against dust, and 7 indicates the capability of withstanding water immersion between 15 centimeters to 1 meter for 30 minutes.

The ultrasonic weld joints may be formed using any ultrasonic welding techniques suitable for coupling the radome 102 to the top cap 108 and/or the bottom cap 112. For example, the ultrasonic weld joints may be formed using a horn to apply pressure to the material of the radome 102 and the top cap 108 and/or bottom cap 112. The top cap 108 and/or bottom cap 112 may be inserted into an opening at an end of the radome 102. The horn may apply pressure to the radome 102 and/or one of the top cap 108 and the bottom cap 112 by vibrating (e.g., vertically, horizontally, etc.) at a rate sufficient to create frictional heat that causes the radome material and cap material to melt and flow together (e.g., 20,000 vibrations per second, 40,000 vibrations per second, etc.).

The radome 102, top cap 108, and bottom cap 112 may comprise any material suitable for ultrasonic welding and for inhibiting ingress of dust, water, etc. In some embodiments, the radome 102, top cap 108 and bottom cap 112 may include plastic material. The plastic material may include polycarbonate material.

Figure 4:
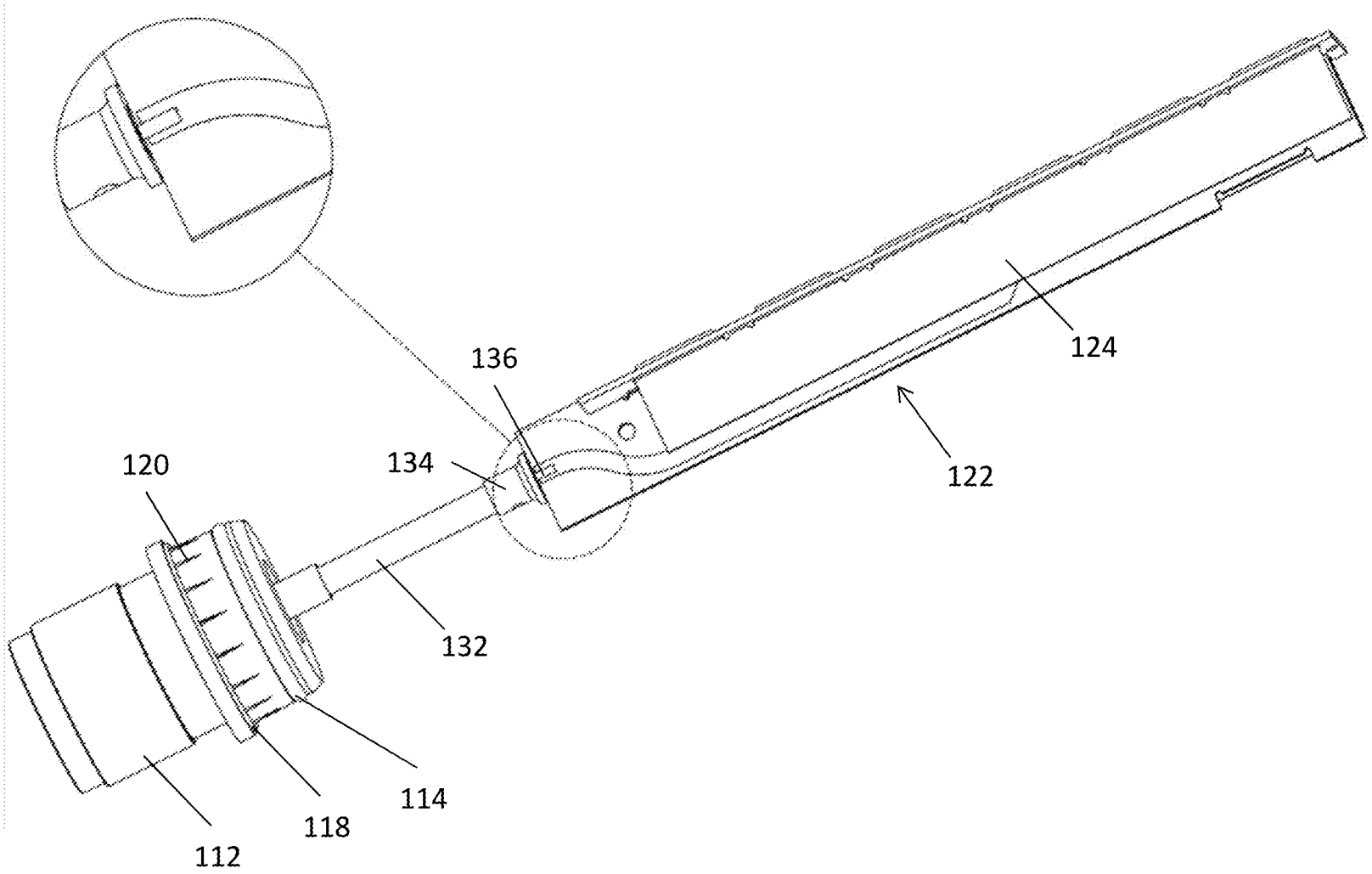
FIG. 4 is a perspective view of the bottom cap, connector, and antenna element shown in FIG. 2.

In some embodiments, the ultrasonic weld joints may include a radial weld joint that extends around an outer circumference (broadly, a perimeter) of the top cap 108 and/or bottom cap 112. As shown in FIG. 4, the bottom cap 112 includes a radial weld joint material 118 disposed around an outer circumference of the bottom cap 112. For example, the radial weld joint material 118 may include an energy director coupled to the bottom cap 112, molded integrally with the bottom cap 112, etc. The energy director may assist in the ultrasonic welding by concentrating vibrational energy at particular location(s) between the bottom cap 112 and the radome 102, etc. Once the bottom cap 112 is inserted into the radome 102 and the ultrasonic welding is performed using a horn, the radial weld joint material 118 may provide a primary radial seal to inhibit dust and/or water from entering the radome 102. For example, the radial weld joint material 118 may melt, flow, fuse, etc. with the radome 102 along an outer circumference of the bottom cap 112 and an inner circumference (broadly, an inner perimeter) of the inner surface 104 of the radome 102, thereby inhibiting dust and/or water from passing through the ultrasonic weld joint and into the radome 102. The top cap 108 may include similar radial weld joint material as the bottom cap 112.

In some embodiments, the ultrasonic weld joints may include an axial weld joint that extends axially along an outer surface of the top cap 108 and/or bottom cap 112 to increase a strength of coupling between the radome 102 and the top cap 108 and/or bottom cap 112. For example, FIG. 4 illustrates a bottom cap 112 having axial weld joint material 120 extending axially along an outer surface of the bottom cap 112. Similar to the radial weld joint material 120, the axial weld joint material may include an energy director. Once the bottom cap 112 is inserted into the radome 102 and the ultrasonic welding is performed using a horn, the axial weld joint material 120 may provide an increased strength of coupling with the radome 102 because the axial weld joint material 118 may melt, flow, fuse, etc. with the radome 102 to increase the amount of radome material and cap material that is coupled together. Additionally, the axial weld joint may provide greater resistance against forces in the axial direction acting on the radome 102 and the bottom cap 112. For example, in some embodiments the axial (and/or radial) ultrasonic weld joint may resist axial pull force of at least twenty five pounds, at least fifty pounds, etc. In some embodiments, the ultrasonic weld joint may provide greater resistance against torque force of at least ten newton meter (N*m), may assist in allowing the assembly 100 to withstand at least a forty-two inch vertical drop, etc. The top cap 108 may include similar axial weld joint material as the bottom cap 112.

As shown in FIG. 3, the top cap 108 and/or bottom cap 112 may have a diameter, circumference, perimeter, etc. that substantially corresponds to a diameter, circumference, perimeter etc. of the radome 102. Accordingly, when coupled to the radome 102 the top cap 108 and/or bottom cap 112 may provide a smooth transition at the joint to increase inhibition of dust and/or water ingress into the radome 102, to provide an aesthetically pleasing assembly 100, etc. For example, in some embodiments there may be substantially no gap between the radome 102 and the top cap 108 and/or bottom cap 112.

When the radome 102 is coupled to the top cap 108 and/or bottom cap 112, excess material may exist at the coupling joint (e.g., at the ultrasonic weld joint, etc.). Accordingly, in some embodiments the excess material may be removed to provide a smooth transition at the joint for aesthetics, dust and/or water inhibition, etc.

In some embodiments, the bottom cap 112 may include an antenna connector 116 disposed in an opening of the bottom cap 112. For example, FIGS. 2 and 3 illustrate an antenna connector 116 disposed in an opening of the bottom cap 112. The antenna connector 116 is adapted for coupling to an external antenna signal source (e.g., antenna cable, complimentary antenna connector, etc.) to receive signals from and/or transmit signals to the external antenna signal source. Accordingly, the antenna connector 116 can allow the antenna assembly 100 to operate with any suitable external antenna signal source.

The antenna assembly 100 can include an antenna element or assembly 122 disposed inside the radome 102.

Accordingly, the radome 102, top cap 108, bottom cap 112, and O-rings 110, 114 can protect the antenna element 122 from damage by inhibiting dust, water, etc. from entering the radome 102 and contacting the antenna element 122. The antenna element or assembly 114 may comprise an antenna element or assembly as disclosed in U.S. Pat. No. 9,331,390 and/or PCT International Publication No. WO 2015/147901, the contents of which are incorporated herein by reference in their entirety.

As shown in FIG. 2, the antenna element 122 can be coupled to the bottom cap 112 before it is inserted into the radome 102. The bottom cap 112 can provide an electrical coupling between the antenna element 122 and the antenna connector 116, thereby allowing signals to be transmitted and/or received between the antenna element 122 and an external antenna signal source. FIG. 3 illustrates the antenna housing assembly 100 after the antenna element 122 is inserted into the radome 102 and the bottom cap 112 is coupled to the radome 102. As shown in FIG. 2, the antenna connector 116 is exposed from an opening in the bottom cap 112 after the bottom cap 112 is coupled to the radome 102 to allow connection to an external antenna signal source (not shown).

The antenna element 122 may be any antenna element suitable for transmitting and/or receiving wireless signals. As shown in FIG. 2, the antenna element 122 includes three printed circuit boards (PCBs) 124 in parallel, which may include a ground plane, a radiating plane, an intermediate plane, a connecting plane, a signal routing plane, etc. The antenna element 122 also includes four vertical PCBs 126 that provide connection paths between the PCBs 124. Other suitable embodiments may include other suitable antenna element configurations without departing from the scope of the present disclosure.

The antenna element 122 may be cushioned, positioned, etc. inside the radome 102 using suitable spacers, padding, etc. For example, FIG. 2 illustrates a pillow pad 128 coupled to an end of the PCBs 124 to position the antenna element 122 in the radome 102. The PCBs 124 also include multiple foam spacers 130 to position the antenna element in the radome 102. The pillow pad 128, foam spacer(s) 130, etc. may be adapted to contact the inner surface 104 of the radome 102 to inhibit contact between the antenna element 122 and the radome 102, provide support for the antenna element 122 inside the radome 102, etc.

Figure 5:
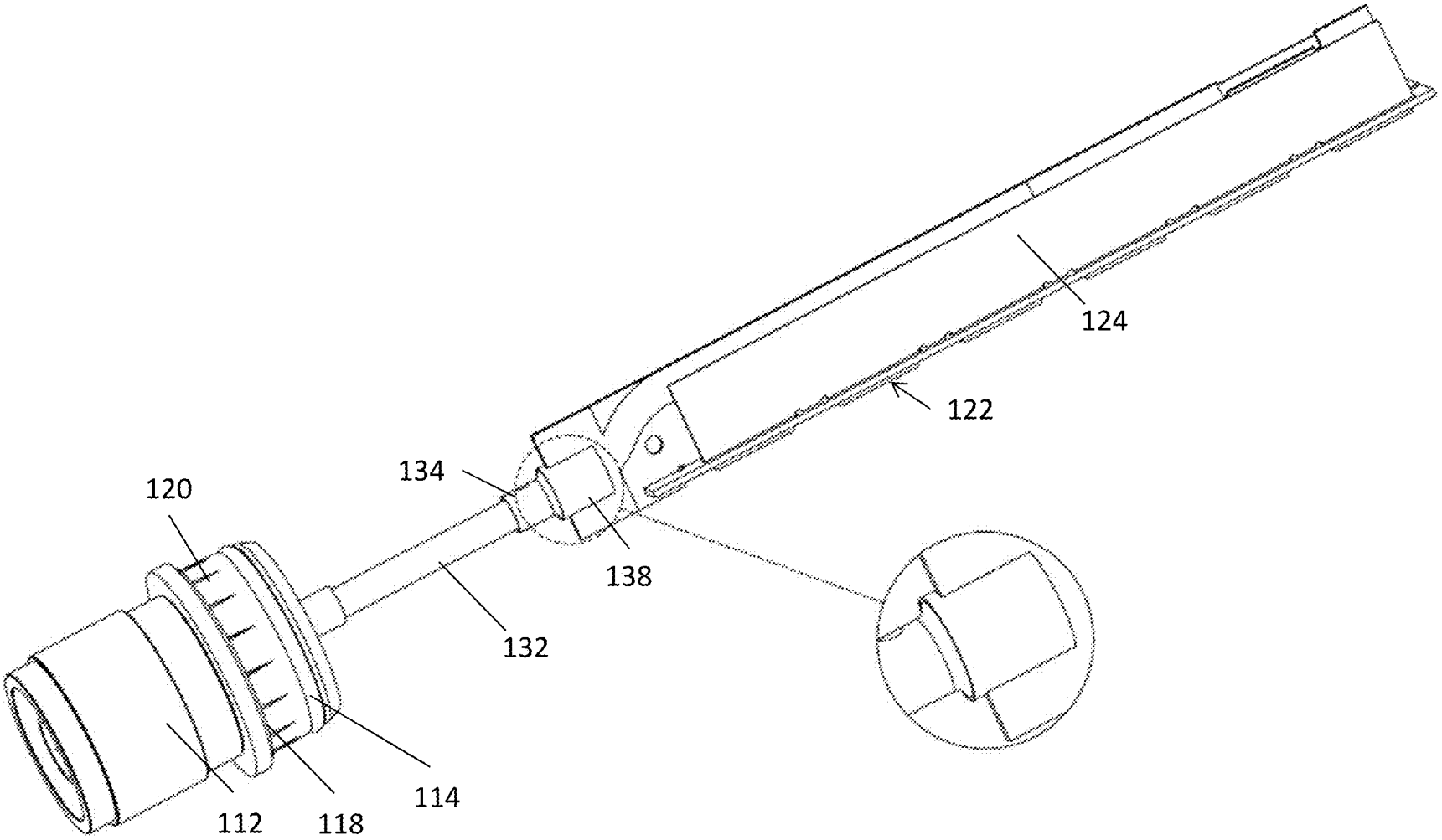
FIG. 5 is a perspective view illustrating the opposite side of the bottom cap, connector, and antenna element shown in FIG. 4.

As shown in FIG. 4, a jumper cable 132 is coupled between the antenna element 122 and the bottom cap 112 to provide signals between the antenna element 122 and the antenna connector 116 in the bottom cap 112, thereby allowing signal transmission between the antenna element 122 and an external antenna signal source. The jumper cable 132 is coupled to the antenna element 122 via an edge connector 134. As shown in FIGS. 4 and 5, the edge connector 134 may include a pin 136 on one side for soldering to a trace of the PCB 124, and a broader support piece 138 on a back side of the edge connector 134 for coupling to a back side of the PCB 124.

Figure 6:
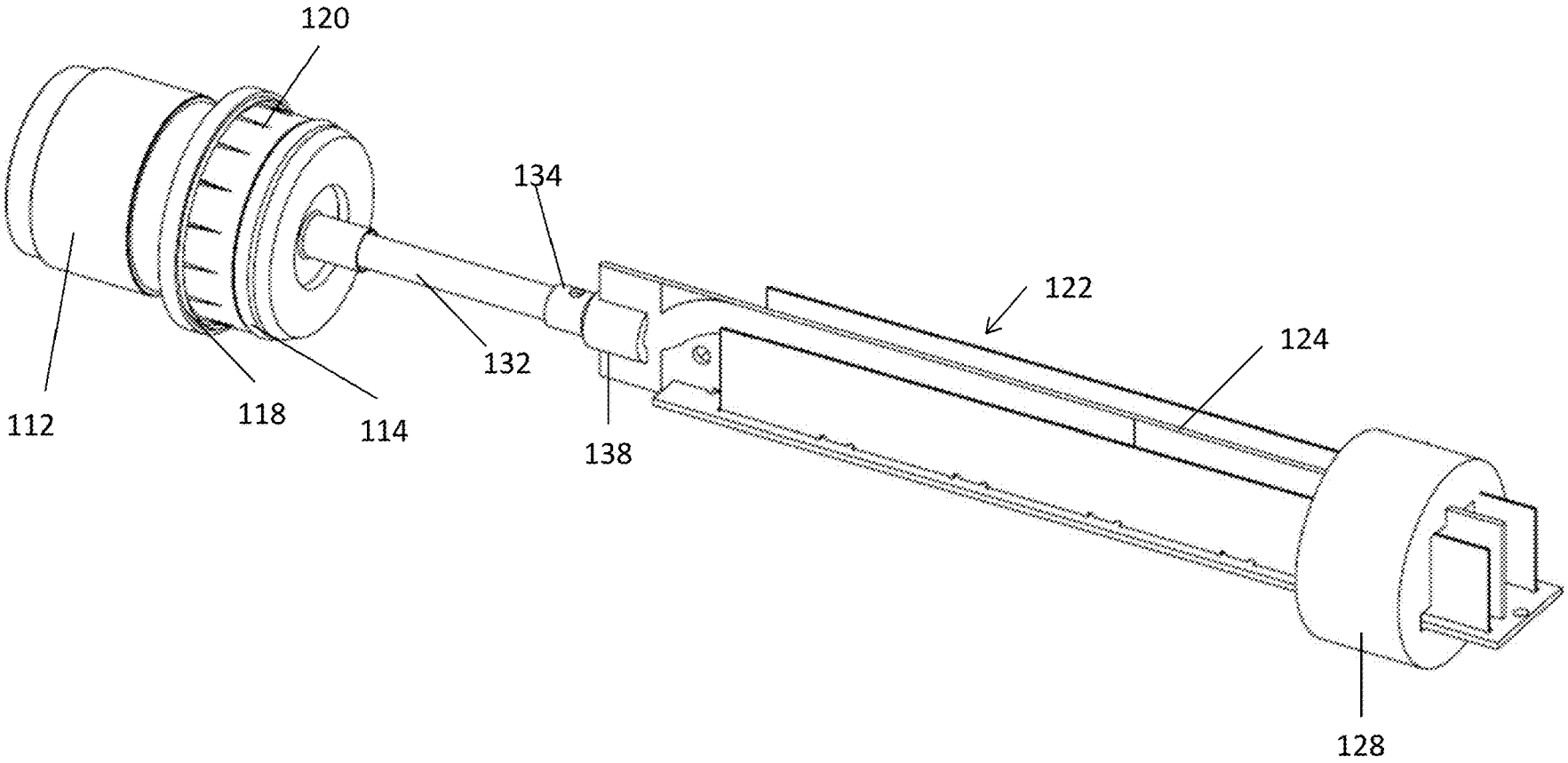
FIG. 6 is a perspective view showing the bottom cap and antenna element shown in FIGS. 4 and 5, further illustrating a foam support.

FIG. 6 illustrates another perspective view of the bottom cap 112 and antenna element 122. As shown in FIG. 6, this example foam pad 128 is substantially circular and surrounds the PCBs 124 at an end of the PCBs 124.

Figure 7:
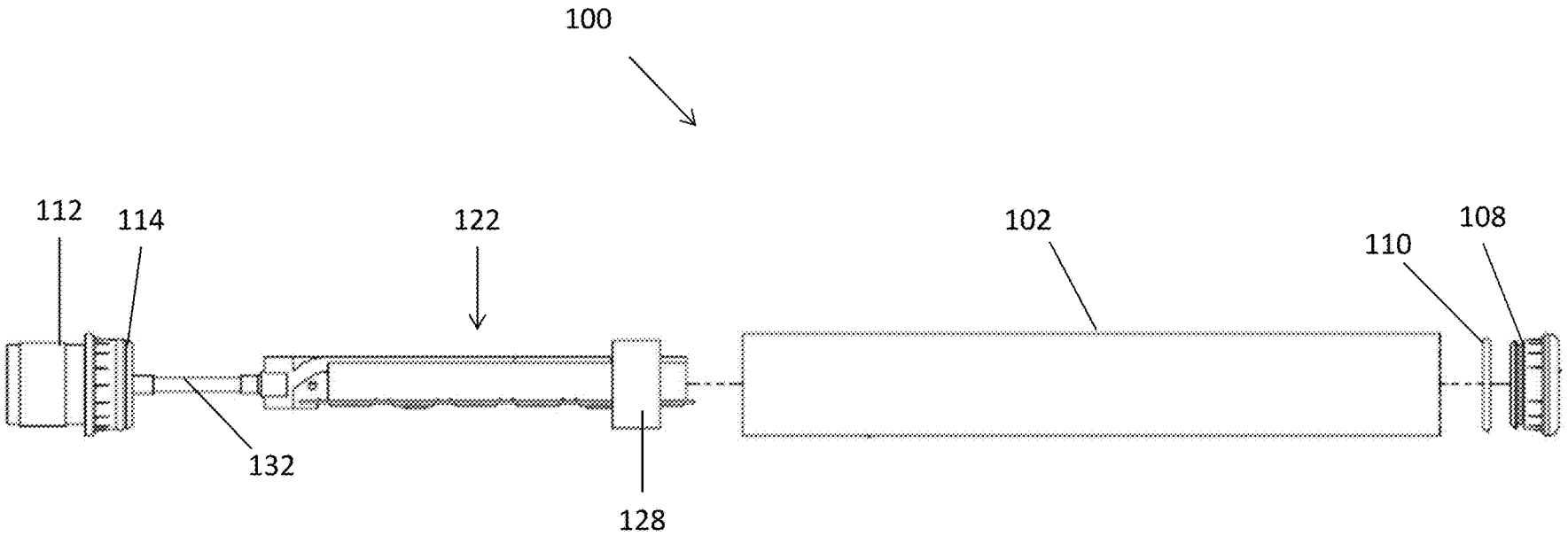
FIG. 7 is an exploded side view showing the antenna housing assembly shown in FIG. 2.

FIG. 7 illustrates an exploded side view of the antenna housing assembly 100 before the top cap 108 and bottom cap 112 are coupled to the radome 102 via ultrasonic welds, and before the O-ring 110 is placed about the top cap 108.

Figure 8:
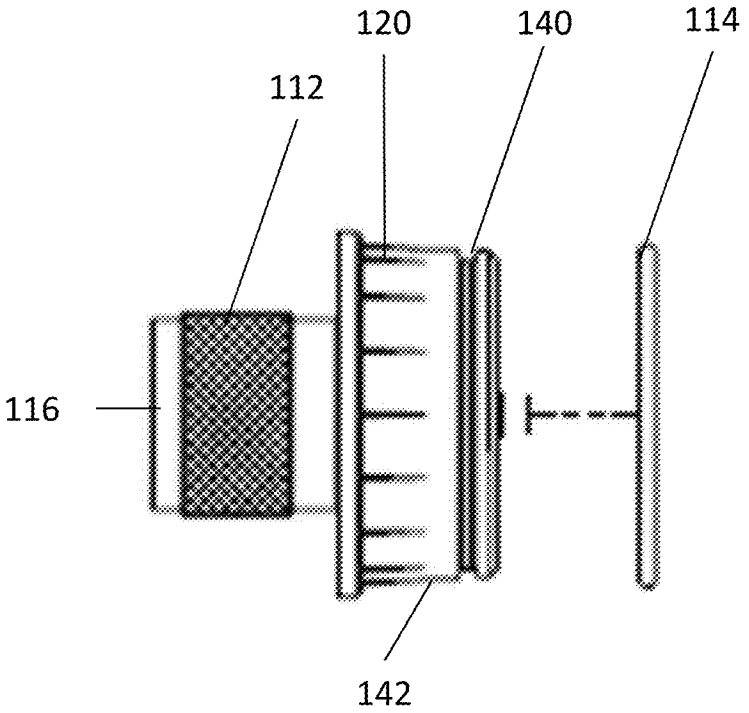
FIG. 8 is an exploded side view of a bottom cap and O-ring shown in FIG. 2.

FIG. 8 illustrates a side exploded view of the bottom cap 112 and the O-ring 114 before the O-ring 114 is coupled to the bottom cap 112. The bottom cap 112 may include a groove 140 adapted to receive the O-ring 114. The groove 140 may include a depth, width, etc. that corresponds to a diameter, circumference, perimeter, etc. of the O-ring 114, such that the O-ring 114 can be placed at least partially in the groove 140 to increase an amount of coupling between the O-ring 114 and the bottom cap 112.

For example, the O-ring 114 may be received in the groove 140 before the bottom cap 112 is coupled to the radome 102, thereby increasing the level of seal protection against ingress of dust, water, etc. into the radome 102. The groove 140 may assist in positioning the O-ring 114 between the bottom cap 112 and the inner surface 104 of the radome 102 when the bottom cap 112 is coupled to the radome 102. The top cap 108 may also include a suitable groove 140 for receiving the O-ring 110.

As shown in FIG. 8, the bottom cap 112 includes an overmold 142. The overmold 142 may cover at least a portion of the antenna connector 116 disposed in the bottom cap 112 to inhibit dust, water, etc. from entering the bottom cap 112 and/or the radome 102. The overmold 142 may be designed to have an interior shape corresponding to a shape of the exterior of the antenna connector 116, thereby allowing the overmold 142 to cover at least a portion of the antenna connector 116 to provide a seal against dust, water, etc.

Figure 9:
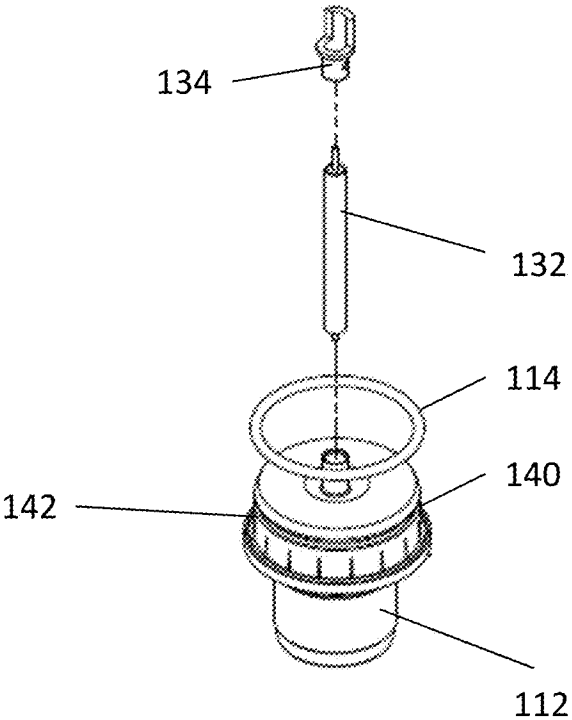
FIG. 9 is an exploded perspective view of the bottom cap, O-ring, jumper, and edge connector shown in FIG. 2.

FIG. 9 illustrates an exploded perspective view of the bottom cap 112, O-ring 114, jumper cable 132, and edge connector 134 before the components are coupled together.

Figure 10A:
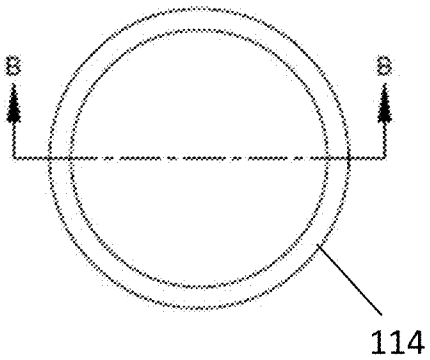
FIG. 10A is a top view of an example O-ring that may be used for the O-rings shown in FIGS. 1 and 2.
Figure 10B:
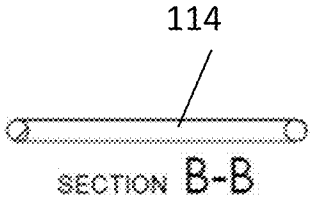
FIG. 10B is a cross-sectional view of the O-ring taken along the line B-B shown in FIG. 10A.

FIGS. 10A and 10B illustrate top and sectional views of the O-ring 114 (which may be the same as O-ring 110).

Figure 11A:
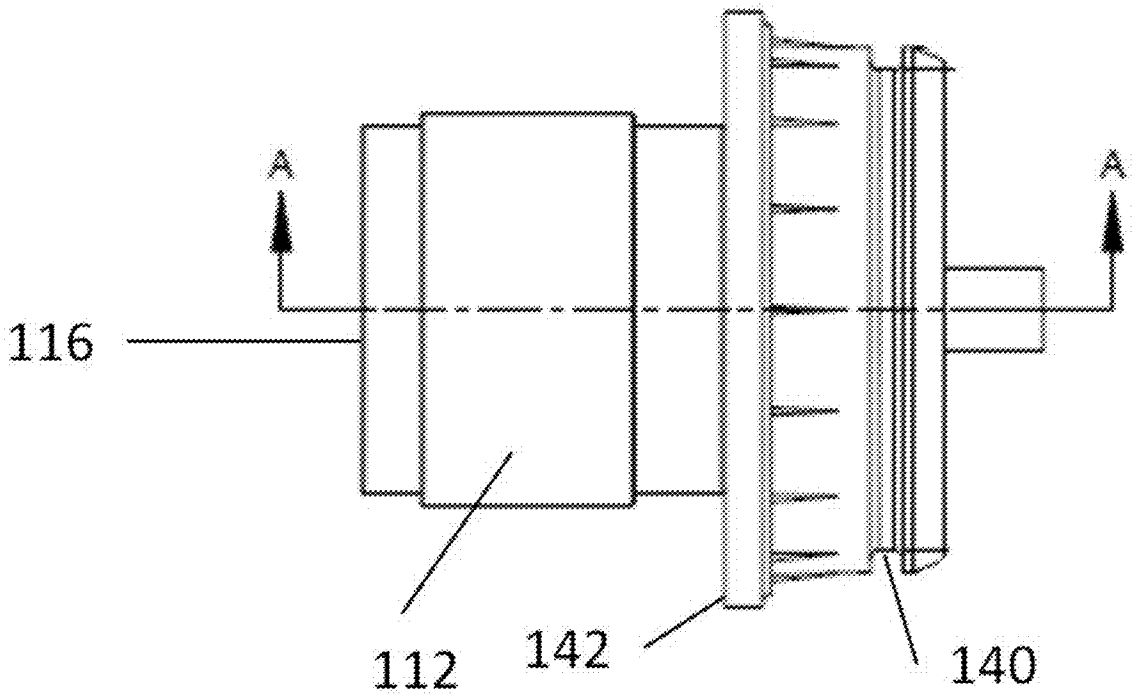
FIG. 11A is a side view of an example bottom cap that may be used for the bottom cap shown in FIG. 2.

FIG. 11A illustrates the bottom cap 112 and overmold 142.

Figure 11B:
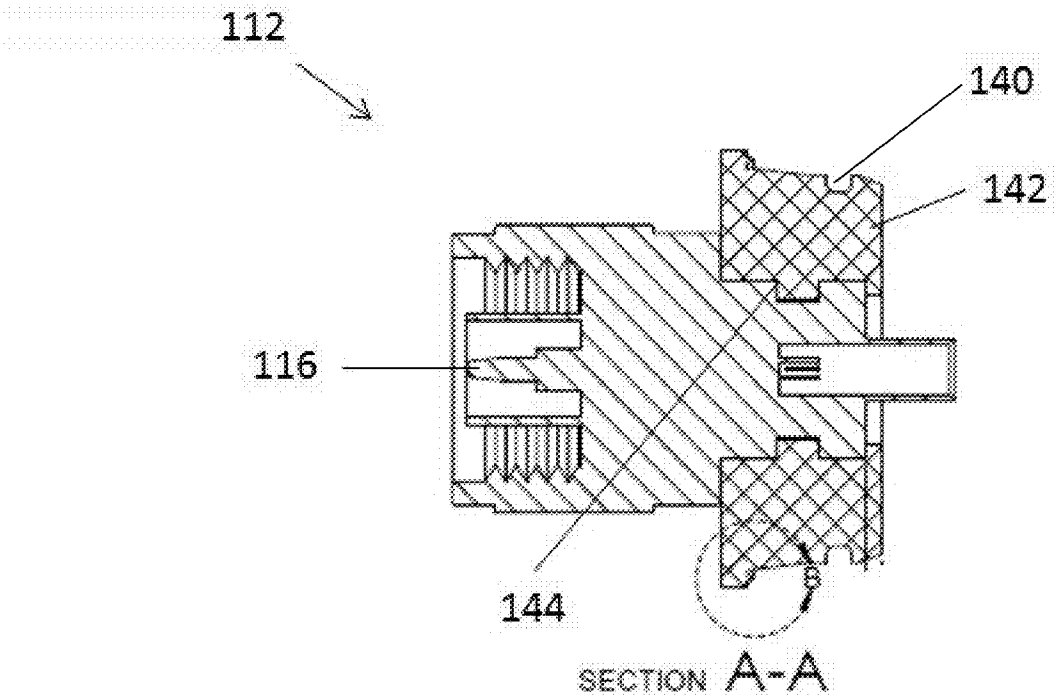
FIG. 11B is a cross-sectional view of the bottom cap taken along the line A-A shown in FIG. 11A.

FIG. 11B illustrates a sectional view showing the antenna connector 116 having one or more undercut features 144. The undercut features 144 of the antenna connector 116 correspond to features of the overmold 142, thereby increasing the coupling between the antenna connector 116 and the overmold 142 to inhibit dust, water, etc. from entering the bottom cap 112, the radome 102, etc.

Figure 11C:
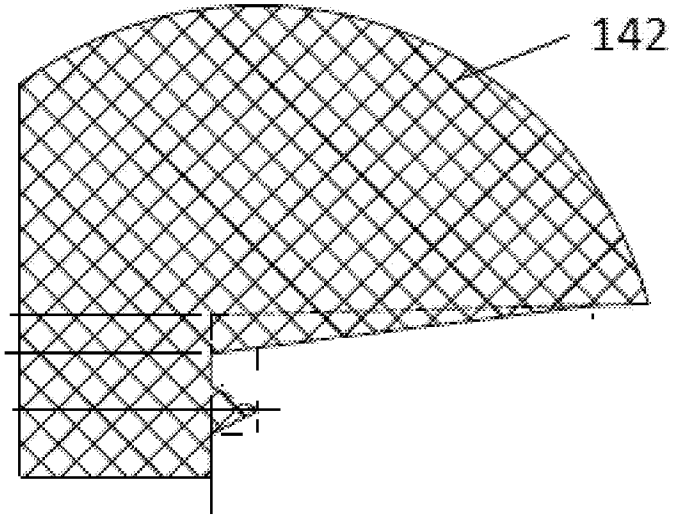
FIG. 11C illustrates the section A-A of the bottom cap shown in FIG. 11B.

FIG. 11C illustrates a sectional view of a portion of the overmold 142. In some embodiments, the overmold 142 may include an energy director material.

Figure 12A:
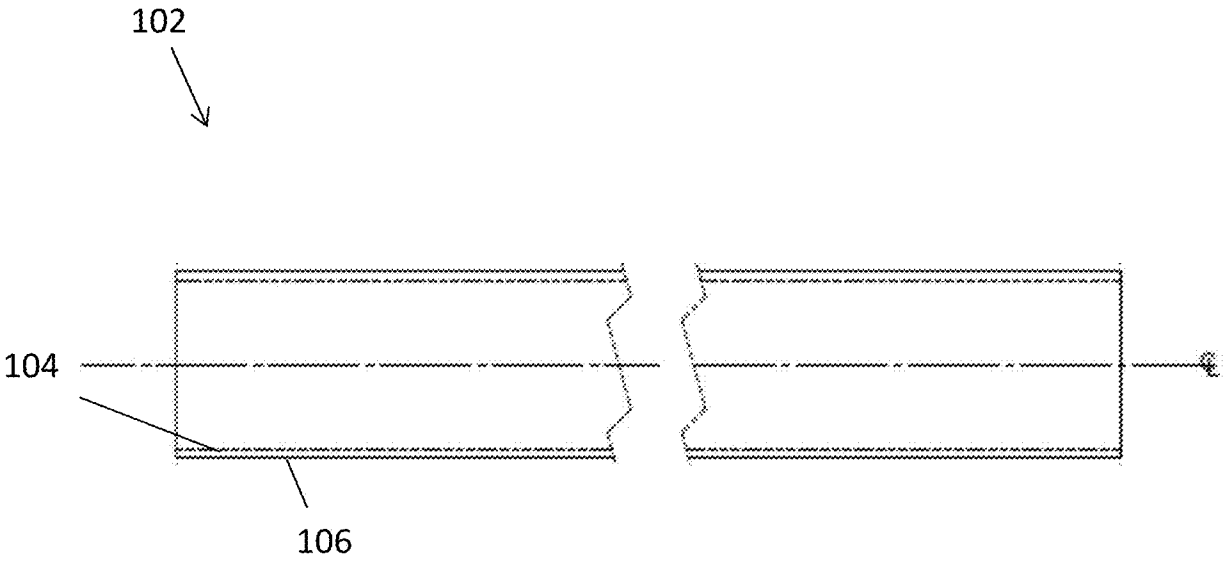
FIG. 12A is a side view of an exemplary radome that may be used for the radome shown in FIG. 1.
Figure 12B:
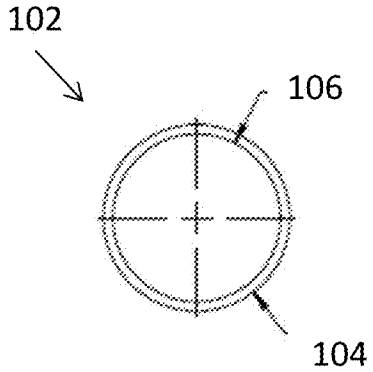
FIG. 12B is an end view of the radome shown in FIG. 12A.

FIGS. 12A and 12B illustrate the cylindrical radome 102, with inner radome surface 104 and outer radome surface 106. Any suitable radome 102 may be used, including radomes having different lengths, different inner diameters, different outer diameters, made of different materials, etc., without departing from the scope of the present disclosure.

Figure 13B:
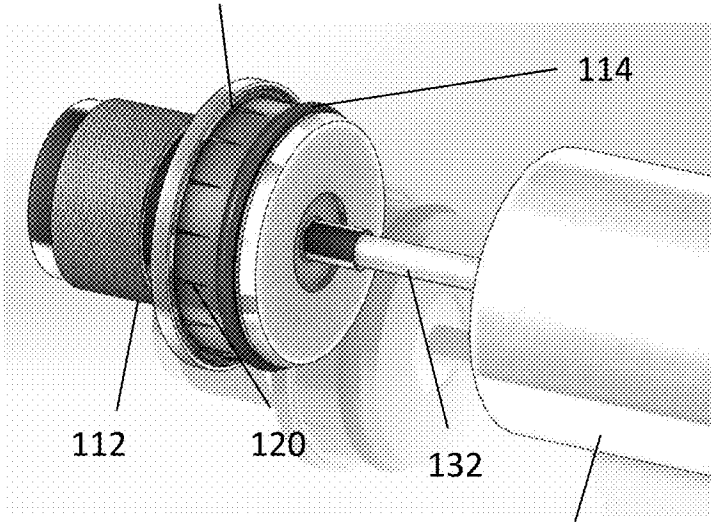
FIG. 13B is an exploded perspective view of an exemplary radome, O-ring and bottom cap that may be used in the antenna housing assembly shown in FIG. 2.
Figure 13A:
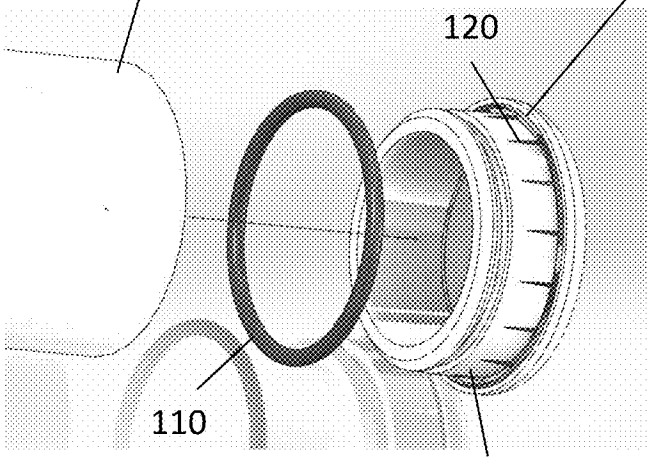
FIG. 13A is an exploded perspective view of an exemplary radome, O-ring and top cap that may be used in the antenna housing assembly shown in FIG. 1.
Figure 13C:
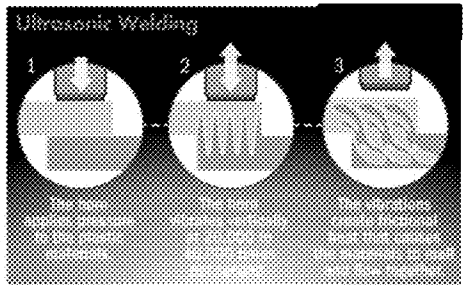
FIG. 13C is a diagram illustrating an exemplary process of ultrasonic welding.

FIGS. 13A, 13B, and 13C illustrate an example ultrasonic welding method that may be used to couple the radome 102 to the top cap 108 and/or bottom cap 112. For example, the top cap 108 and bottom cap 112 include radial ultrasonic weld joint material 118 and axial ultrasonic weld joint material 120. When the ultrasonic welding is implemented as shown in FIG. 13C, the radial ultrasonic weld joint material 118 and axial ultrasonic weld joint material 120 will melt and flow together with the material of the radome 102, thereby coupling the top cap 108 and bottom cap 112 to the radome 102 via axial and radial ultrasonic weld joints.

As shown in FIG. 13C, the ultrasonic welding process may include using a horn to apply pressure to plastic materials (e.g., the radial ultrasonic weld joint material 118, axial ultrasonic weld joint material 120, radome 102, etc.). The horn may vibrate vertically at 20,000 to 40,000 times per second. The horn vibrations can create frictional heat that causes the materials to melt and flow together. In other embodiments, other suitable ultrasonic welding processes may be used to couple the radome 102 to the top cap 108 and bottom cap 112.

Figure 14B:
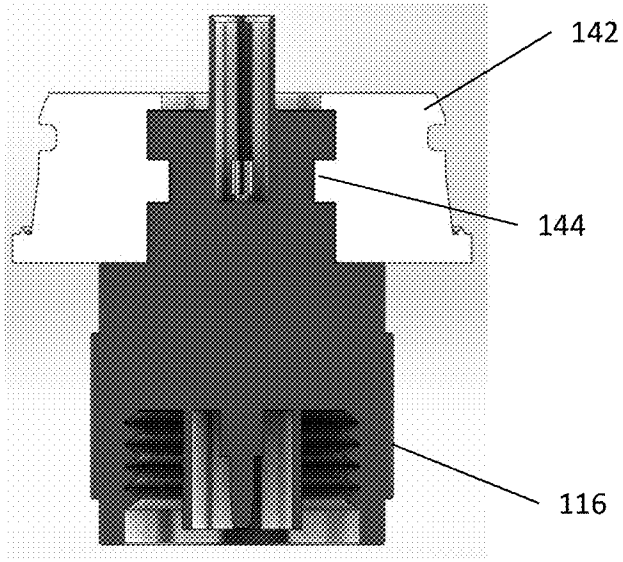
FIG. 14B is a cross-sectional side view of the bottom cap shown in FIG. 14A.
Figure 14A:
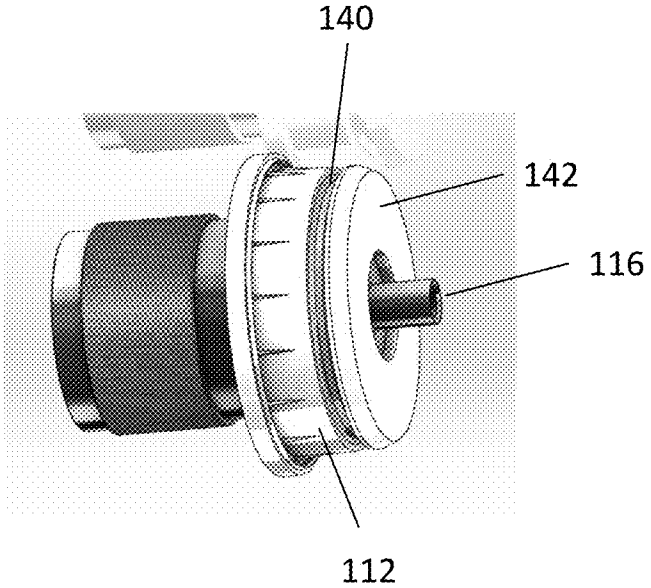
FIG. 14A is a perspective view of an exemplary bottom cap that may be used in the antenna housing assembly shown in FIG. 2.
Figure 14C:
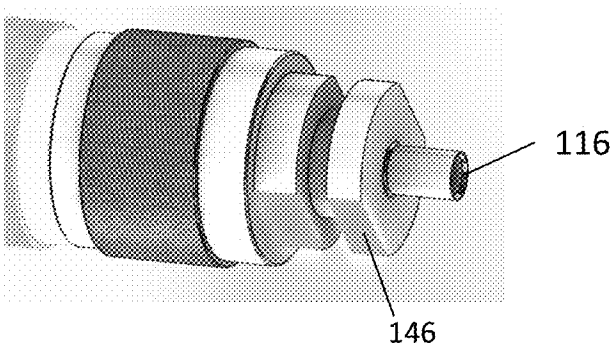
FIG. 14C is a perspective view of the antenna connector shown in FIG. 14B.

FIGS. 14A, 14B, and 14C illustrate the bottom cap 112, the overmold 142 and the antenna connector 116. For example, FIG. 14A illustrates the bottom cap 112 with the overmold 142 disposed about the antenna connector 116.

FIG. 14B is a sectional view illustrating the overmold 142 disposed about the antenna connector 116. As shown in FIG. 14B, the antenna connector 116 includes multiple undercut features 144 to increase the sealing against dust, water, etc. from entering the bottom cap 112, the radome 102, etc. The undercut features 144 may correspond to the shape of the overmold 142 to increase coupling, sealing, etc. between the antenna connector 116 and the overmold 142.

FIG. 14C illustrates the antenna connector 116, which may include a non-rotational joint 146. The flat surfaces on the joint 146 may inhibit the antenna connector 116 from rotating. For example, the overmold 142 may include surfaces corresponding to a shape of the non-rotational joint 146 to inhibit rotation of the antenna connector 116 relative to the overmold 142. The non-rotational joint 146 may provide ruggedized fastening between the antenna connector 116 and the overmold 142 to increase a strength of coupling between the antenna connector 116 and the overmold, to inhibit ingress of dust and/or water, etc.

According to another exemplary embodiment, a method of assembling an antenna housing is disclosed. The exemplary method generally includes placing a first sealing member (e.g., O-ring, urethane foam sealing member, a resiliently compressible elastomeric or foam sealing member, a PORON microcellular urethane foam sealing member, etc.) about a top cap (e.g., about an outer perimeter or circumference of the top cap, etc.) and coupling the top cap to a radome (e.g., a cylindrical radome, etc.) via an ultrasonic weld, such that the first sealing member contacts an inner surface of the radome. The method also includes placing a second sealing member (e.g., O-ring, urethane foam sealing member, a resiliently compressible elastomeric or foam sealing member, a PORON microcellular urethane foam sealing member, etc.) about a bottom cap (e.g., about an outer perimeter or circumference of the bottom cap, etc.), and coupling the bottom cap to the radome at an end of the radome opposite the top cap via an ultrasonic weld, such that the second sealing member of the bottom cap contacts an inner surface of the radome.

In some embodiments, the method may further include inserting an antenna element into the radome prior to coupling the bottom cap to the radome. The first and second sealing members comprise first and second O-rings. The top cap may include at least one radial groove along a circumference of the top cap. And, the method may include placing the first O-ring into the at least one radial groove of the top cap along the circumference of the top cap. Similarly, the bottom cap may include at least one radial groove along a circumference of the bottom cap. And, the method may include placing the second O-ring into the at least one radial groove of the bottom cap along the circumference of the bottom cap.

In some embodiments, coupling the top cap to the radome may include coupling the top cap to the radome via a radial ultrasonic weld to inhibit dust and water from entering the radome. Coupling the bottom cap to the radome may include coupling the bottom cap to the radome via a radial ultrasonic weld to inhibit dust and water from entering the radome.

Additionally, or alternatively, coupling the top cap to the radome may include coupling the top cap to the radome via an axial ultrasonic weld to increase a strength of coupling between the radome and the top cap. Coupling the bottom cap to the radome may include coupling the bottom cap to the radome via an axial ultrasonic weld to increase a strength of coupling between the radome and the bottom cap.

In some embodiments, the bottom cap can include an antenna connector disposed in an opening of the bottom cap. The bottom cap may be adapted to cover at least a portion of the antenna connector with an overmold having at least one undercut feature inhibit dust and water from entering the radome via the bottom cap.

The radome, the top cap, and the bottom cap may comprise a plastic material. For example, the radome, the top cap, and the bottom cap may include polycarbonate. The radome may be a cylindrical radome having a diameter. A diameter of the top cap may substantially correspond to a diameter of the cylindrical radome. Similarly, a diameter of the bottom cap may substantially correspond to a diameter of the cylindrical radome.

In some embodiments, the method may further include smoothing an outer surface of the ultrasonic weld joint between the radome and the top cap to remove excess material. Similarly, the method may include smoothing an outer surface of the ultrasonic weld joint between the radome and the bottom cap to remove excess material.

In some embodiments, the radome may comprise a cylindrical radome. The first and second sealing members may comprise first and second O-rings. The method may include placing the first O-ring about an outer circumference of the top cap, and placing the second O-ring about an outer circumference of the bottom cap.

Exemplary embodiments are disclosed of antenna housing assemblies. In an exemplary, an assembly generally includes a radome. A top cap is coupled to the radome using a radial ultrasonic weld joint to inhibit dust and water from entering the housing. A first sealing member (e.g., O-ring, urethane foam sealing member, a resiliently compressible elastomeric or foam sealing member, a PORON microcellular urethane foam sealing member, etc.) is disposed adjacent to the top cap inside the radome. A bottom cap is coupled to the radome using a radial ultrasonic weld joint to inhibit dust and water from entering the housing. A second sealing member (e.g., O-ring, urethane foam sealing member, a resiliently compressible elastomeric or foam sealing member, a PORON microcellular urethane foam sealing member, etc.) is disposed adjacent to the bottom cap inside the radome. A connector is disposed inside the bottom cap. The radial ultrasonic weld joints may provide a primary seal to inhibit dust and water from entering the housing. The first and second sealing members may provide a secondary seal to inhibit dust and water from entering the housing.

The top cap may be further coupled to the radome using an axial ultrasonic weld joint. The bottom cap may be further coupled to the radome using an axial ultrasonic weld joint. An antenna element or assembly may be positioned inside the radome and connected to the connector. The connector may include at least one undercut feature.

The bottom cap may be an overmolded part that is made from polycarbonate or other plastic, etc. The bottom cap may be overmolded over the connector to inhibit dust and water from entering the housing. At least one of the radome, top cap, or bottom cap may comprise a plastic material. The plastic material may comprise polycarbonate.

In an exemplary embodiment, the antenna housing assembly may have an aesthetically pleasing and/or clean look and is configured to mount directly to a radio or a mast, IP67 weather proof, and ruggedized. The antenna housing assembly may be assembled without using glues, adhesives and RTVs. The antenna housing includes a radome (e.g., a cylindrical radome having scalable diameters and lengths, etc.) radome made of polycarbonate or other plastic. A top cap is coupled to the radome using ultrasonic weld joints both radially and axially to the radome. An inner sealing member (e.g., O-ring, etc.) maintains a secondary IP67 seal. A radial ultrasonic weld joint is the primary seal. The ultrasonic weld joint is also mechanical fastening or coupling mechanism. A bottom cap is an overmolded part that is made from polycarbonate or other plastic. Similar to the top cap, the bottom cap uses ultrasonic welded features (radial, axial) to weld onto the radome. An inboard sealing member (e.g., O-ring, etc.) is used again as a secondary seal. The ultrasonic weld joint is the primary seal. The ultrasonic weld joint is also mechanical fastening or coupling mechanism. The overmolded bottom cap may be overmolded over connectors of different types to maintain a good IP67 seal, non-rotational joint, and ruggedized fastening. The connector may include multiple undercut features to maintain robustness. The antenna housing is fully IP67 in this exemplary embodiment.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms (e.g., different materials may be used, etc.) and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values (e.g., frequency ranges, etc.) for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). Similarly, it is envisioned that disclosure of two or more ranges of values for a parameter (whether such ranges are nested, overlapping or distinct) subsume all possible combination of ranges for the value that might be claimed using endpoints of the disclosed ranges.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "includes," "including," "has," "have," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An assembly comprising:

a radome having an outer surface, an inner surface, a first end, and a second end opposite the first end;

a top cap coupled to the first end of the radome via an ultrasonic weld joint configured to provide a first or primary seal between the top cap and the first end of the radome to inhibit dust and water from entering the radome;

a first sealing member disposed about the top cap and positioned between the top cap and the inner surface of the radome, the first sealing member configured to provide a second or secondary seal between the top cap and the inner surface of the radome to inhibit dust and water from entering the radome;

a bottom cap coupled to the second end of the radome via an ultrasonic weld joint configured to provide a first or primary seal between the bottom cap and the second end of the radome to inhibit dust and water from entering the radome; and a second sealing member disposed about the bottom cap and positioned between the bottom cap and the inner surface of the radome, the second sealing member configured to provide a second or secondary seal between the bottom cap and the inner surface of the radome to inhibit dust and water from entering the radome;

wherein:

the ultrasonic weld joint between the top cap and the first end of the radome is integrally defined by material fused together from the top cap and the radome; and the ultrasonic weld joint between the bottom cap and the second end of the radome is integrally defined by material fused together from the bottom cap and the radome.

2. The assembly of claim 1, wherein the bottom cap includes an antenna connector disposed in an opening of the bottom cap and configured for coupling with an antenna cable.

3. The assembly of claim 2, further comprising an antenna element positioned inside the radome, an edge connector, a jumper cable coupled to the antenna element via the edge connector and configured to be operable to provide signals between the antenna element and the antenna connector.

4. The assembly of claim 2, wherein the bottom cap is adapted to cover at least a portion of the antenna connector with an overmold having at least one undercut feature, and the antenna connector includes at least one undercut feature that corresponds to the at least one undercut feature of the overmold, thereby increasing the coupling between the antenna connector and the overmold to inhibit dust and water from entering the radome via the bottom cap.

5. The assembly of claim 1, wherein:

at least one of the radome, the top cap, and the bottom cap comprises a plastic material; or at least one of the radome, the top cap, and the bottom cap comprises polycarbonate.

6. The assembly of claim 1, wherein:

the radome comprises a cylindrical radome; and the first and second sealing members comprise first and second O-rings.

7. The assembly of claim 1, wherein the radome comprises a cylindrical radome having a diameter, and wherein:

a diameter of the top cap substantially corresponds to the diameter of the cylindrical radome; and/or a diameter of the bottom cap substantially corresponds to the diameter of the cylindrical radome.

8. The assembly of claim 1, wherein the bottom cap includes an antenna connector, and wherein the assembly further comprises an antenna element positioned inside the radome, an edge connector, and a jumper cable coupled to the antenna element via the edge connector and configured to be operable to provide signals between the antenna element and the antenna connector.

9. The assembly of claim 1, wherein the bottom cap includes an antenna connector including at least one undercut feature, and wherein the bottom cap is adapted to cover at least a portion of the antenna connector with an overmold having at least one undercut feature that corresponds to the at least one undercut feature of the antenna connector, thereby increasing the coupling between the antenna connector and the overmold to inhibit dust and water from entering the radome via the bottom cap.

10. The assembly of claim 1, wherein the bottom cap includes an antenna connector configured for coupling with an antenna cable, and an overmold covering at least a portion of the antenna connector.

11. The assembly of claim 1, wherein the bottom cap includes a coaxial cable connector configured for coupling with an coaxial cable.

12. The assembly of claim 1, wherein:

the ultrasonic weld joint between the top cap and the first end of the radome includes a radial ultrasonic weld joint that extends along an outer perimeter of the top cap and along an inner perimeter of an inner surface of the first end of the radome, and an axial ultrasonic weld joint axially along an outer surface of the top cap;

the ultrasonic weld joint between the bottom cap and the second end of the radome includes a radial ultrasonic weld joint that extends along an outer perimeter of the bottom cap and along an inner perimeter of an inner surface of the second end of the radome, and an axial ultrasonic weld joint axially along an outer surface of the bottom cap;

the first and second sealing members comprise first and second O-rings;

the top cap includes at least one radial groove along an outer circumference of the top cap, and the first O-ring is disposed in the at least one radial groove of the top cap along the outer circumference of the top cap;

the bottom cap includes at least one radial groove along an outer circumference of the bottom cap, and the second O-ring is disposed in the at least one radial groove of the bottom cap along the outer circumference of the bottom cap; and the bottom cap includes an antenna connector configured for coupling with an antenna cable, and an overmold covering at least a portion of the antenna connector such that a non-rotational joint is defined between the antenna connector and the overmold that inhibits rotation of the antenna connector relative to the overmold.

13. An assembly comprising:

a radome having an outer surface, an inner surface, a first end, and a second end opposite the first end;

a top cap coupled to the first end of the radome via an ultrasonic weld joint configured to provide a first or primary seal between the top cap and the first end of the radome to inhibit dust and water from entering the radome;

a first sealing member disposed about the top cap and positioned between the top cap and the inner surface of the radome, the first sealing member configured to provide a second or secondary seal between the top cap and the inner surface of the radome to inhibit dust and water from entering the radome;

a bottom cap coupled to the second end of the radome via an ultrasonic weld joint configured to provide a first or primary seal between the bottom cap and the second end of the radome to inhibit dust and water from entering the radome; and a second sealing member disposed about the bottom cap and positioned between the bottom cap and the inner surface of the radome, the second sealing member configured to provide a second or secondary seal between the bottom cap and the inner surface of the radome to inhibit dust and water from entering the radome;

wherein the ultrasonic weld joints include:

a radial ultrasonic weld joint along an outer perimeter of the top cap and along an inner perimeter of an inner surface of the first end of the radome that provides the first or primary seal between the top cap and the first end of the radome for inhibiting dust and water from entering the radome; and a radial ultrasonic weld joint along an outer perimeter of the bottom cap and along an inner perimeter of an inner surface of the second end of the radome that provides the first or primary seal between the bottom cap and the second end of the radome for inhibiting dust and water from entering the radome.

14. The assembly of claim 13, wherein:

the radial ultrasonic weld joint between the top cap and the first end of the radome is integrally defined by material fused together from the top cap and the radome; and the radial ultrasonic weld joint between the bottom cap and the second end of the radome is integrally defined by material fused together from the bottom cap and the radome.

15. An assembly comprising:

a radome having an outer surface, an inner surface, a first end, and a second end opposite the first end;

a top cap coupled to the first end of the radome via an ultrasonic weld joint configured to provide a first or primary seal between the top cap and the first end of the radome to inhibit dust and water from entering the radome;

a first sealing member disposed about the top cap and positioned between the top cap and the inner surface of the radome, the first sealing member configured to provide a second or secondary seal between the top cap and the inner surface of the radome to inhibit dust and water from entering the radome;

a bottom cap coupled to the second end of the radome via an ultrasonic weld joint configured to provide a first or primary seal between the bottom cap and the second end of the radome to inhibit dust and water from entering the radome; and a second sealing member disposed about the bottom cap and positioned between the bottom cap and the inner surface of the radome, the second sealing member configured to provide a second or secondary seal between the bottom cap and the inner surface of the radome to inhibit dust and water from entering the radome;

wherein the ultrasonic weld joints include:

an axial ultrasonic weld joint axially along an outer surface of the top cap to increase a strength of coupling between the radome and the top cap; and an axial ultrasonic weld joint axially along an outer surface of the bottom cap to increase a strength of coupling between the radome and the bottom cap.

16. An assembly comprising:

a radome having an outer surface, an inner surface, a first end, and a second end opposite the first end;

a top cap coupled to the first end of the radome via an ultrasonic weld joint configured to provide a first or primary seal between the top cap and the first end of the radome to inhibit dust and water from entering the radome;

a first sealing member disposed about the top cap and positioned between the top cap and the inner surface of the radome, the first sealing member configured to provide a second or secondary seal between the top cap and the inner surface of the radome to inhibit dust and water from entering the radome;

a bottom cap coupled to the second end of the radome via an ultrasonic weld joint configured to provide a first or primary seal between the bottom cap and the second end of the radome to inhibit dust and water from entering the radome; and a second sealing member disposed about the bottom cap and positioned between the bottom cap and the inner surface of the radome, the second sealing member configured to provide a second or secondary seal between the bottom cap and the inner surface of the radome to inhibit dust and water from entering the radome;

wherein the first and second sealing members comprise first and second O-rings, and wherein:

the top cap includes at least one radial groove along an outer circumference of the top cap, and the first O-ring is disposed in the at least one radial groove of the top cap along the outer circumference of the top cap; and the bottom cap includes at least one radial groove along an outer circumference of the bottom cap, and the second O-ring is disposed in the at least one radial groove of the bottom cap along the outer circumference of the bottom cap.

17. An assembly comprising:

a radome having an outer surface, an inner surface, a first end, and a second end opposite the first end;

a top cap coupled to the first end of the radome via an ultrasonic weld joint configured to provide a first or primary seal between the top cap and the first end of the radome to inhibit dust and water from entering the radome;

a first sealing member disposed about the top cap and positioned between the top cap and the inner surface of the radome, the first sealing member configured to provide a second or secondary seal between the top cap and the inner surface of the radome to inhibit dust and water from entering the radome;

a bottom cap coupled to the second end of the radome via an ultrasonic weld joint configured to provide a first or primary seal between the bottom cap and the second end of the radome to inhibit dust and water from entering the radome; and a second sealing member disposed about the bottom cap and positioned between the bottom cap and the inner surface of the radome, the second sealing member configured to provide a second or secondary seal between the bottom cap and the inner surface of the radome to inhibit dust and water from entering the radome;

wherein the bottom cap includes an antenna connector and an overmold covering at least a portion of the antenna connector such that a non-rotational joint is defined between the antenna connector and the overmold that inhibits rotation of the antenna connector relative to the overmold.

18. The assembly of claim 17, wherein:

the ultrasonic weld joint between the top cap and the first end of the radome is integrally defined by material fused together from the top cap and the radome; and the ultrasonic weld joint between the bottom cap and the second end of the radome is integrally defined by material fused together from the bottom cap and the radome.

19. An assembly comprising:

a radome having an outer surface, an inner surface, a first end, and a second end opposite the first end;

a top cap coupled to the first end of the radome via an ultrasonic weld joint configured to provide a first or primary seal between the top cap and the first end of the radome to inhibit dust and water from entering the radome;

a first sealing member disposed about the top cap and positioned between the top cap and the inner surface of the radome, the first sealing member configured to provide a second or secondary seal between the top cap and the inner surface of the radome to inhibit dust and water from entering the radome;

a bottom cap coupled to the second end of the radome via an ultrasonic weld joint configured to provide a first or primary seal between the bottom cap and the second end of the radome to inhibit dust and water from entering the radome; and a second sealing member disposed about the bottom cap and positioned between the bottom cap and the inner surface of the radome, the second sealing member configured to provide a second or secondary seal between the bottom cap and the inner surface of the radome to inhibit dust and water from entering the radome;

wherein the bottom cap includes an antenna connector and an overmold covering at least a portion of the antenna connector, the antenna connector includes opposing flat surfaces, and the overmold includes surfaces corresponding to a shape of the opposing flat surfaces of the antenna connector, to thereby inhibit rotation of the antenna connector relative to the overmold.

20. An assembly comprising:

a radome having an outer surface, an inner surface, a first end, and a second end opposite the first end;

a top cap coupled to the first end of the radome via an ultrasonic weld joint configured to provide a first or primary seal between the top cap and the first end of the radome to inhibit dust and water from entering the radome;

a first sealing member disposed about the top cap and positioned between the top cap and the inner surface of the radome, the first sealing member configured to provide a second or secondary seal between the top cap and the inner surface of the radome to inhibit dust and water from entering the radome;

a bottom cap coupled to the second end of the radome via an ultrasonic weld joint configured to provide a first or primary seal between the bottom cap and the second end of the radome to inhibit dust and water from entering the radome; and a second sealing member disposed about the bottom cap and positioned between the bottom cap and the inner surface of the radome, the second sealing member configured to provide a second or secondary seal between the bottom cap and the inner surface of the radome to inhibit dust and water from entering the radome;

wherein:

the ultrasonic weld joint between the top cap and the first end of the radome includes a radial ultrasonic weld joint along an outer perimeter of the top cap and along an inner perimeter of an inner surface of the first end of the radome, and an axial ultrasonic weld joint axially along an outer surface of the top cap; and the ultrasonic weld joint between the bottom cap and the second end of the radome includes a radial ultrasonic weld joint along an outer perimeter of the bottom cap and along an inner perimeter of an inner surface of the second end of the radome, and an axial ultrasonic weld joint axially along an outer surface of the bottom cap.

* * * * *